US005508716A

United States Patent [19]

Prince et al.

[11] Patent Number: 5,508,716

[45] Date of Patent: Apr. 16, 1996

[54] PLURAL LINE LIQUID CRYSTAL ADDRESSING METHOD AND APPARATUS

[75] Inventors: Dennis W. Prince, Banks; Benjamin R. Clifton, Oregon City; Terry J. Scheffer, Portland; Arlie R. Conner, Tualatin, all of Oreg.

[73] Assignee: In Focus Systems, Inc., Wilsonville, Oreg.

[21] Appl. No.: 258,467

[22] Filed: Jun. 10, 1994

[51] Int. Cl.[6] ..... G09G 3/36

[52] U.S. Cl. ..... 345/103; 345/100

[58] Field of Search ..... 345/87, 99, 103, 345/100, 94, 59; 348/790, 792, 793; 359/54, 55, 45

[56] References Cited

U.S. PATENT DOCUMENTS 5,091,784 2/1992 Someya et al. ..... 345/87
5,262,881 11/1993 Kuwata et al. ..... 359/55

FOREIGN PATENT DOCUMENTS 0507061 10/1992 European Pat. Off. ..... 345/98

OTHER PUBLICATIONS

Kazuhiro Okada et al., "Video-Rate STN-LCDs for Projection and Camcorder Applications", Sid International Symposium, Digest of Technical Papers (May 1991), pp. 430–433.

H. Hirai et al., "Optimization of Cell Condition and Driving Method in a VAN LCD for Color Video Display," Proceedings of the 9th International Display Research Conference (Oct. 16–28, 1989), pp.184–187.

*Primary Examiner*—Richard Hjerpe
*Assistant Examiner*—Doom Chow
*Attorney, Agent, or Firm*—Stoel Rives

[57] ABSTRACT

A method and an apparatus for addressing a liquid crystal display (10) groups together row electrodes (28) and applies the same row addressing signal to all row electrodes in the group (48). The groupings are cyclically changed in successive addressing cycles. An image data conditioner (54) determines for use in calculating the column signals a pixel information value based upon the information values of one or more of the pixels in the selected group of row. Grouping the row electrodes reduces the effective multiplex ratio, thereby increasing the selection ratio and producing a faster responding display having higher contrast and a wider viewing angle.

21 Claims, 5 Drawing Sheets

PLURAL LINE LIQUID CRYSTAL ADDRESSING METHOD AND APPARATUS

TECHNICAL FIELD

The present invention relates to a method and system for addressing rms-responding displays and, in particular, to a method and system for improving picture quality while reducing hardware requirements.

BACKGROUND OF THE INVENTION

Flat panel displays are used in a wide variety of applications including, for example, televisions, notebook computers, projection systems, and wireless communications devices, such as cellular telephones. Images are formed on flat panel displays by electrically controlling the optical properties of a large number of individual picture elements, or "pixels," made of an electro-optical material, such as a liquid crystal material. The large number of pixels allows the formation of arbitrary information patterns in the form of text or graphic images by controlling the optical transmission of an arbitrary number of pixels. The optical state of each pixel, which depends upon the voltage present across it, is controlled by applying electrical signals to addressing electrodes. The number of electrodes necessary to address the large number of pixels is greatly reduced by having each electrode address multiple pixels. In a passive matrix display, transparent electrodes are typically positioned on opposing inner surfaces of parallel, transparent plates. A matrix of pixels is typically formed by electrodes arranged in horizontal rows on one plate and vertical columns on the other plate to provide a pixel wherever a row and column electrode overlap. Addressing signals determined by the image to be displayed in accordance with any number of addressing techniques are placed onto the electrodes by addressing signal voltage drivers. Multiple periodic addressing signals are required to display a complete image.

A complete image is typically displayed in a time interval known as a "frame period." To form an image during the frame period, rows are typically "selected," i.e., have a non-zero voltage applied, during "selection intervals" that comprise the frame period. Image-dependent column signals determined in accordance with the addressing technique are applied to the columns in each addressing interval. The optical response of the pixel is determined by the root mean square ("rms") of the potential difference over the frame period between the row and column electrodes.

Passive matrix liquid crystal displays typically use an Alt and Pleshko-type method of addressing the display, in which rows are selected sequentially during addressing intervals by the application of a row voltage, and, the column voltage applied during each addressing interval depends upon the desired optical state of the pixel defined by the row selected during the addressing interval and the corresponding column.

Image data indicating the desired optical state of the pixels during a frame period can be presented to the display in a variety of formats. Typically, the image data for the rows and for the pixels within each row are presented sequentially. Television signals present the pixel image data from all the odd numbered scan lines in a first "field" period and then the data from even numbered scan lines in a second "field" period. Control signals are typically interspersed within the image data. The term "addressing cycle" is used by applicants to mean either a field or a frame period.

Fast-responding liquid crystal displays are desirable because such displays are necessary for showing moving video images, which are produced by rapidly changing a series of still images. When a fast responding liquid crystal material is used, however, the liquid crystal material within a pixel has an opportunity to relax between successive selections of the row defining the pixel, causing an undesirable optical effect known as "frame response," described in Kaneko et al., "Full Color STN Video LCDs," *Proceedings of Eurodisplay* '90, pp. 100–103 (Tenth Annual International Display Research Conference, Amsterdam, the Netherlands, 1990).

A typical liquid crystal display may have 480 rows and 640 columns that intersect to form a matrix of 307,200 pixels. It is expected that matrix liquid crystal displays may soon comprise several million pixels. As the multiplex ratio, i.e., the number of matrix rows overlapping each column electrode, increases, the ratio of the time in which a row is selected to the frame period decreases. Each row, therefore, is selected for a relatively shorter time period, resulting in a decrease in the selection ratio, i.e., the ratio over a frame period of the rms voltage across an "ON" pixel to that of an "OFF" pixel.

A reduced selection ratio results in a reduced contrast ratio, i.e., the ratio of the light transmission of a light pixel to that of a dark pixel. A reduced selection ratio also results in a display having a slower response time, i.e., pixels are slower to change their optical state in response to changes in the addressing signals from frame to frame. A display having a reduced selection ratio also exhibits a narrower viewing angle.

One method used to reduce the multiplex ratio when addressing large numbers of rows, the "dual scan method," entails dividing a display into two separately addressed sections, with each display section having an independent set of column and row electrodes. The column electrodes of each display section overlap only the row electrodes of the same display section. A dual scan display typically has a higher contrast ratio than that of a "single scan" display having the same number of rows, but the dual scan display requires additional addressing hardware, including an additional set of column drivers. Moreover, because of the electrical connections required at the edges of the display panel, only two display panels can be vertically stacked without producing unacceptable gaps in the composite image.

SUMMARY OF THE INVENTION

An object of the present invention is, therefore, to improve the contrast ratio in a multiplexed passive matrix display.

Another object of this invention is to increase the selection ratio of a multiplexed passive matrix display having a given number of rows.

A further object of this invention is to increase the number of rows of a multiplexed passive matrix display without decreasing the selection ratio.

Yet another object of this invention is to decrease the response time and widen the viewing angle of such a display.

Still another object of this invention is to reduce the amount and complexity of hardware required to drive a such a display.

The present invention is an addressing method and apparatus for increasing the selection ratio of an rms-responding, passive matrix liquid crystal display by grouping together adjacent row electrodes and applying the same row addressing signal to each of the electrodes in a particular group. The grouping of the row electrodes typically changes cyclically for subsequent addressing cycles.

Grouping "r" number of rows together results in a decrease in the effective multiplex ratio, i.e., the number of groups of rows crossed by each column electrode, of approximately a factor of r. Reducing the effective multiplex ratio increases the selection ratio, thereby improving the contrast ratio, viewing angle, and switching speed. Alternatively, the number of rows addressed can be increased over that of a prior art display by a factor of r without significantly reducing the selection ratio. In some applications, the invention eliminates the need for a dual scan display, thereby reducing the interconnect density, the complexity of the driving electronics, and the power consumption of the display.

The addressing signal applied to a column electrode at a particular time is typically dependent upon the image data of the pixels defined by the column electrode and the row electrodes being selected. In the present invention, a column signal is derived from a row group image information value determined by the pixel data of one or more pixels defined by the column electrode and the group or groups of row electrodes being addressed. For example, the image datum of any single pixel defined by the column and a group of row electrodes being selected could be used, or an average of all image data of pixels defined by the column and the group of row electrodes.

Applying the same row addressing signal to the multiple rows in a group results in a confounding of the image portions in the grouped rows. Although such confounding can result in reduced resolution in the vertical direction for large groups, it can also produce for smaller groups an improved image by producing gray shades that reduce the abrupt intensity changes at the image boundaries. By reducing such abrupt intensity changes, which are to some degree inherent in the discrete pixel structure of a liquid crystal display, the present invention forms natural images, such as those of people and landscapes, better than prior art liquid crystal displays form such images.

The invention is also suited for use with an Active Addressing™-type addressing technique in which rows are selected during multiple addressing intervals distributed throughout an addressing cycle.

Additional objects and advantages of the present invention will be apparent from the following detailed description of preferred embodiments thereof, which proceeds with reference to the accompanying drawings.

DETAILED DESCRIPTION OF PREFERRED EMBODIMENTS

Figure 1:
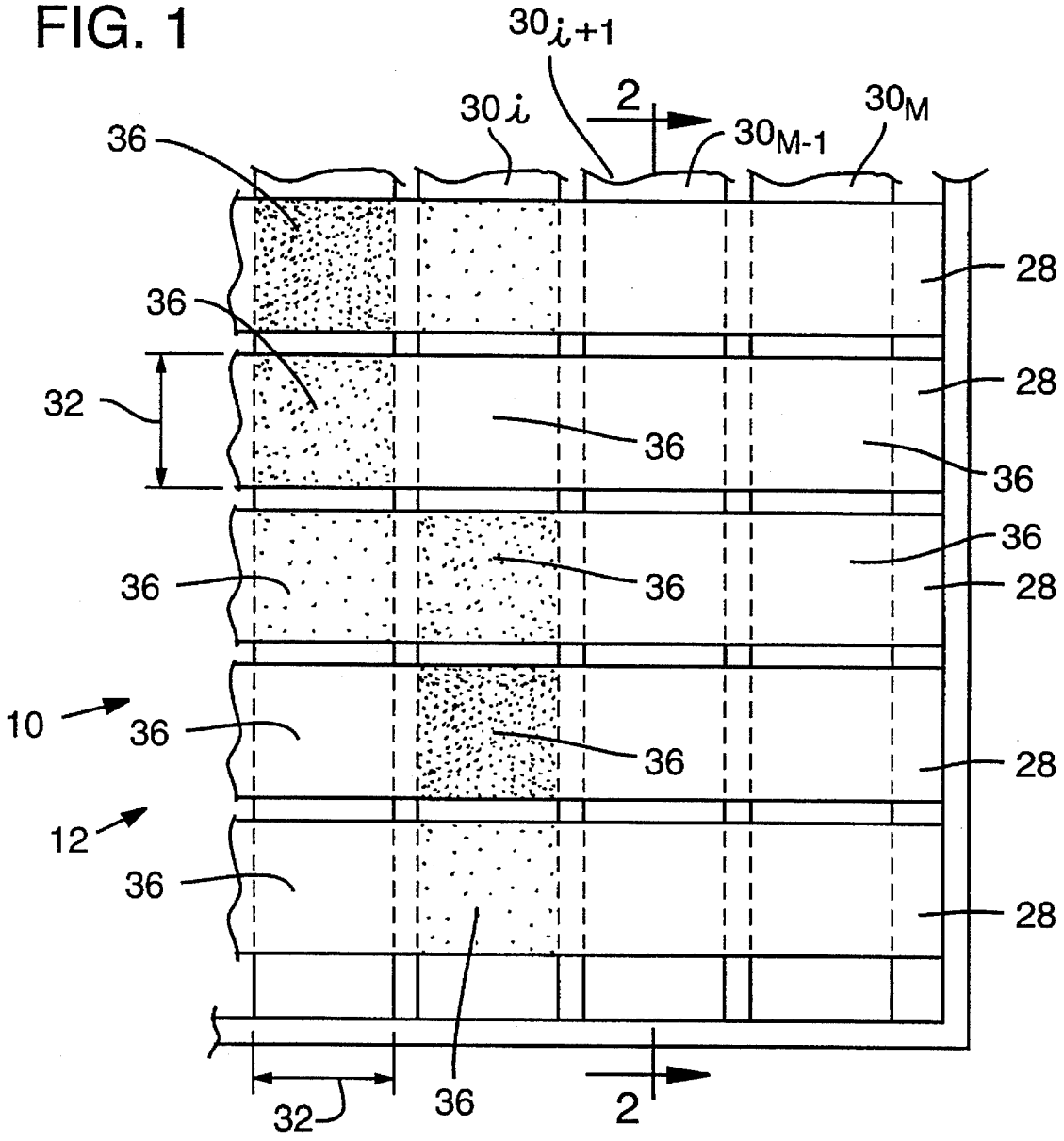
FIG. 1 is a diagrammatic, fragmentary plan view of a liquid crystal display in accordance with the present invention.
Figure 2:
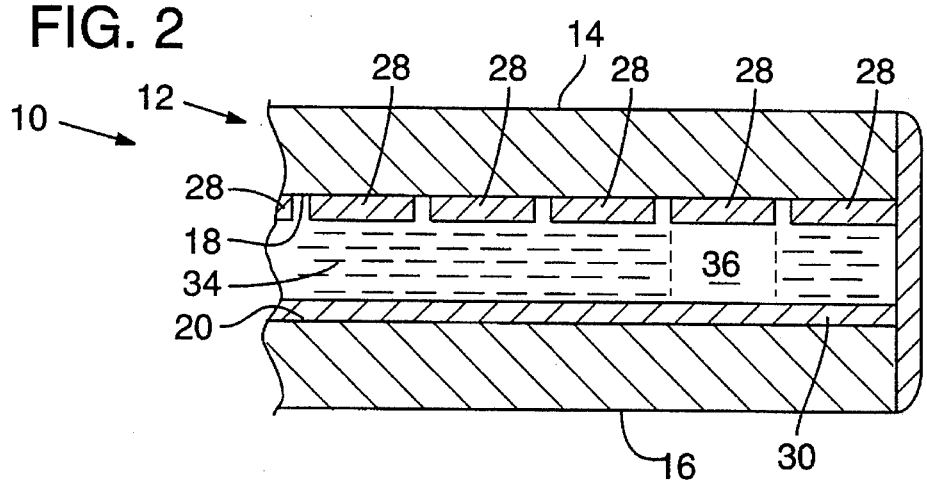
FIG. 2 is a sectional view taken along lines 2—2 of FIG. 1.

FIGS. 1 and 2 show part of a typical rms-responding display system 10 comprising a display 12 including two glass plates 14 and 16 having on their respective inner surfaces 18 and 20 respective first and second sets of electrodes 28 and 30. First and second sets of electrodes, 28 and 30, will be referred to as row electrodes 28 and column electrodes 30, although it is clear that this designation is arbitrary and that either set of electrodes could be arranged as rows or columns and either set of electrodes could be oriented horizontally or vertically. Row electrodes 28 and column electrodes 30 are preferably perpendicular to each other and of equal width 32. An electro-optical material, such as a nematic liquid crystal 34 operated in a supertwist mode, is positioned between plates 14 and 16. The overlapping areas of row electrodes 28 and column electrodes 30 define a matrix of picture elements or pixels 36. Although pixels 36 are shown in optical states having a variety of gray levels, it will be understood that the invention can also be applied to a display without intermediate gray levels. Display system 10 includes a large number of such pixels 36, an arbitrary number of which are capable of together forming arbitrary information patterns by controlling the transmission of an arbitrary number of pixels in each column.

The optical state of each pixel 36 is controlled by the voltage across it, the actual "pixel voltage." The pixel voltage at a pixel 36 is determined by the potential difference between the row electrode 28 and column electrode 30 at the overlapping area that defines the pixel 36. Drivers apply addressing signals to electrodes 28 and 30 in accordance with an addressing technique during multiple addressing intervals that make up an addressing cycle. In a typical addressing technique, image-independent voltage waveforms are applied to row electrodes 28 and image-dependent waveforms are applied to column electrodes 30. In the present invention, multiple row electrodes are grouped together and receive the same image-independent voltage waveforms over one addressing cycle.

Figure 3A:
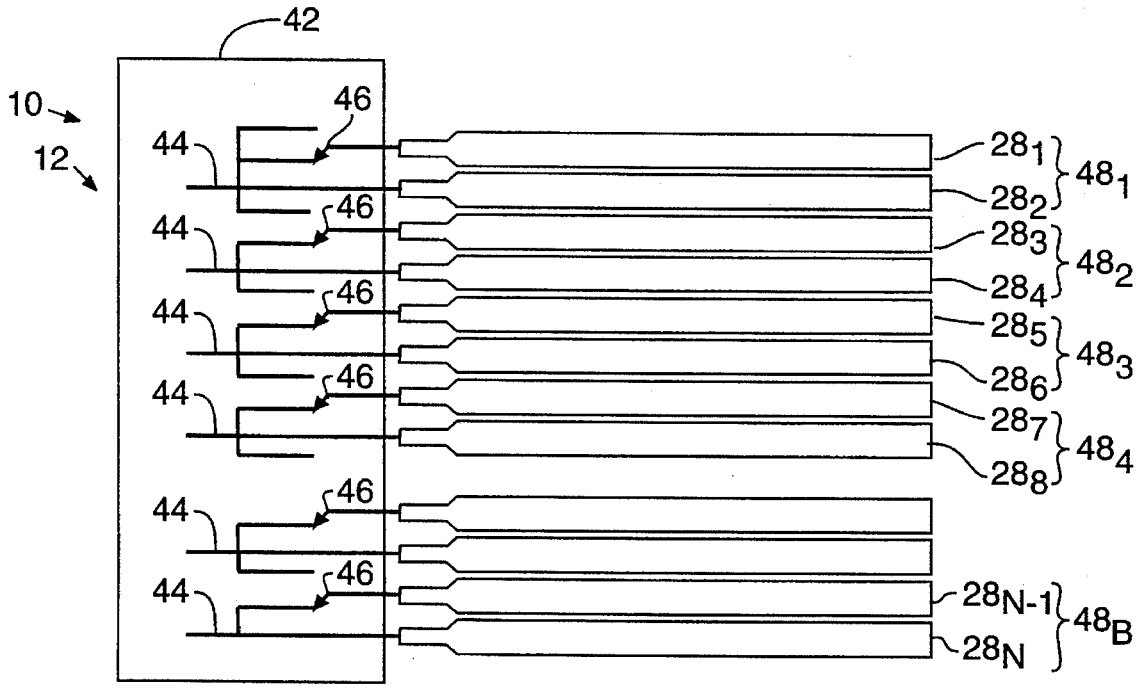
FIGS. 3*a* and 3*b* are schematic representations showing an example of how row electrodes can be addressed by the present invention.
Figure 3B:
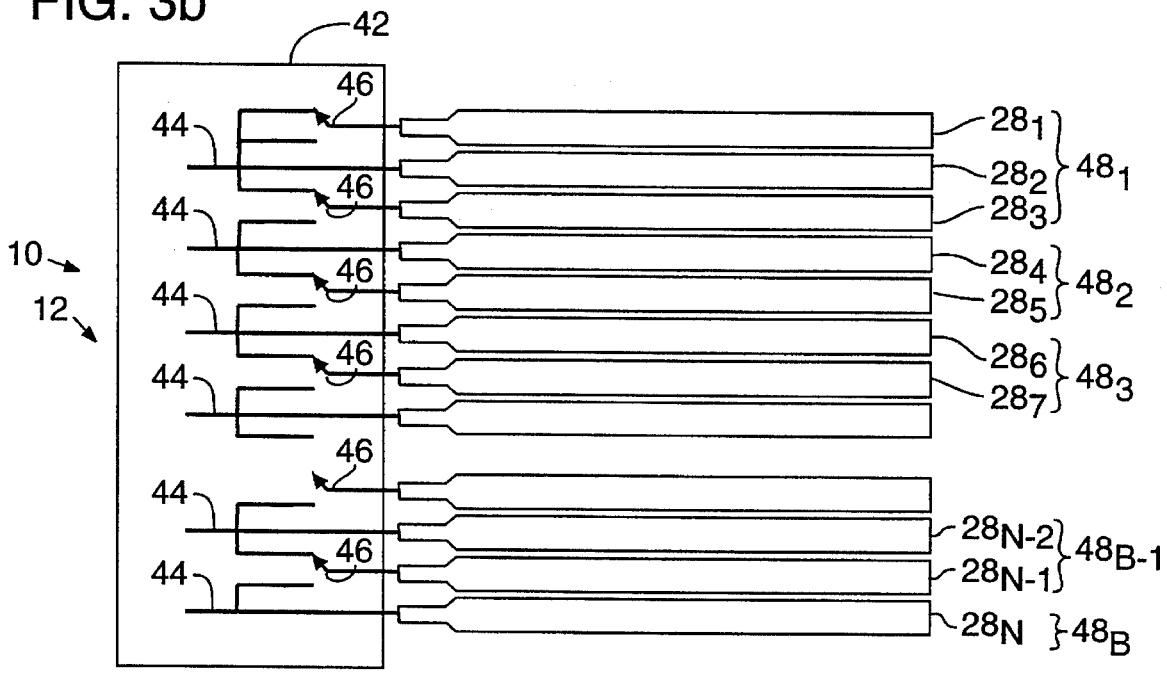

FIGS. 3*a* and 3*b* show part of a display 10 in which row electrodes $\mathbf{28}_1$, $\mathbf{28}_2$, $\mathbf{28}_3$ . . . , $\mathbf{28}_N$ are grouped into pairs to reduce the multiplex ratio of the display in accordance with the present invention. To illustrate the principals of the present invention, FIGS. 3*a* and 3*b* show row electrodes 28 connected within a row electrode driver 42 to conductors 44 through switches 46. Switches 46 are used only for purposes of illustration. It will be understood that, in a typical embodiment, row electrode driver 42 places the same addressing signal onto all row electrodes 28 within a group 48 and that row electrodes 28 within a group 48 are not electrically connected by actual switches 46.

Every second one of row electrodes 28, such as row electrodes $\mathbf{28}_1$, $\mathbf{28}_3$, and $\mathbf{28}_5$, is referred to hereafter as an "odd electrode," and each of the other row electrodes 28, such as row electrodes $\mathbf{28}_2$, $\mathbf{28}_4$, and $\mathbf{28}_6$, is referred to as an "even" electrode. FIGS. 3*a* and 3*b* show that even electrodes are directly connected to conductors 44, and odd row electrodes 28 are connected to conductors 44 through switches 46.

After each addressing cycle, the position of switch 46 is changed to group odd row 28 alternately to the even row electrodes 28 above and below it, thereby changing the composition of groups 48. FIG. 3*a* shows the position of switch 46 during a first addressing cycle, and FIG. 3*b* shows the position of switch 46 during a subsequent addressing cycle. FIGS. 3*a* and 3*b* show that row electrode $\mathbf{28}_1$, the top row electrode of display 10, and row 28N, the bottom row electrode of display 10, are configured somewhat differently from other row electrodes 28. Row electrode $\mathbf{28}_1$ is always grouped with row electrode $\mathbf{28}_2$. During alternate addressing cycles, row electrode $\mathbf{28}_3$ is grouped with row electrodes $\mathbf{28}_1$ and $\mathbf{28}_2$, to create a three electrode group, or to row electrode $\mathbf{28}_4$, to create a two electrode group. Row electrode $\mathbf{28}_N$ alternates between being the single row electrode 28 in its group 48, and being grouped with row electrode $\mathbf{28}_{N-1}$. The configuration of the top and bottom row electrodes 28 may be changed depending on the total number of row electrodes 28.

It will be understood that in other embodiments of the invention, the number of electrodes 28 forming each group and the algorithm for changing the groupings of row electrode 28 in subsequent addressing cycles can be varied.

In accordance with the present invention, row electrodes 28 can comprise a group 48 of different sizes. In a display having "N" number of row electrodes, grouping "r" number of electrodes together reduces the multiplex ratio by approximately a factor of r. Although the resolution of display 10 in the vertical direction decreases somewhat with increasing r, the displayed image may actually appear more natural for r=2 or r=3 because of the resulting increased number of intermediate gray levels and because of the smoothing of the abrupt brightness changes between pixels.

Figure 4:
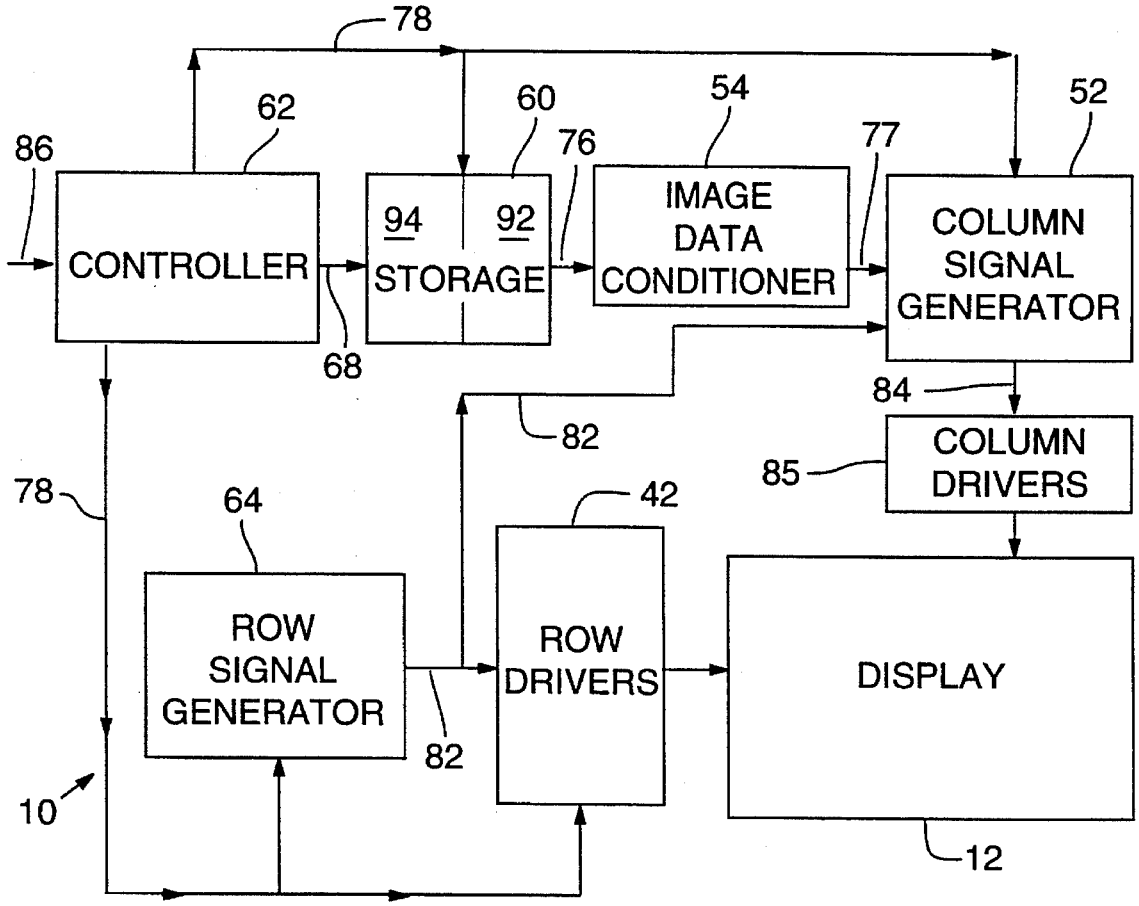
FIG. 4 is a block diagram of a typical display system incorporating the invention and using an Active Addressing™-type addressing technique.

FIG. 4 illustrates the components and operation of a preferred display system 10 implemented in accordance with an Active Addressing™-type addressing technique embodying the plural line addressing method of the present invention.

A controller 62 receives video signals from an external source (not shown) via an external bus 86. The video signals include timing and control signals, which may include horizontal and vertical synchronization information, and video image data signals. Upon receipt of video signals, controller 62 formats the display data and transmits the formatted data via a data bus 68 to storage means 60.

A typical storage means 60 comprises storage circuits 92 and 94 that, in response to control signals provided by controller 62, accumulate and store the formatted display data for later use by an image data conditioner 54. Storage circuits 92 and 94 alternate between accumulating display data corresponding to a complete addressing cycle, i.e., pixels information data for M columns and N (for frame data) or N/2 (for field data) rows, and providing the pixel information data via a second data bus 76 to image data conditioner 54. When either of storage circuits 92 and 94 is accumulating image data, the other storage circuit holds a complete image data set for use by image data conditioner 54.

When an entire addressing cycle of display data has been accumulated, controller 62 switches the functions of storage 92 and 94 between accumulating data and providing data and initiates three operations that occur substantially in parallel. First, controller 62 signals storage means 60 to begin accepting new video data and accumulating data for a new addressing cycle in storage circuit 92 or 94. Second controller 62 initiates the process for converting the display data stored in storage circuit 92 into column signals $CS_1$-$CS_M$ corresponding to columns 1 to M and having amplitudes $G_{K_1}(\Delta t_k)$–$G_{k_N}(\Delta t_k)$. Third, controller 62 instructs row signal generator 64 to supply to column signal generator 52 and to row drivers 42 a row function vector $S(\Delta t_k)$ having elements corresponding to the values of each of the row functions during time interval $\Delta t_k$.

As described above, one row function $S_m$ is provided by row signal generator 64 for each group 48 of row electrodes 28. Each row function $S_m$ is preferably a member of an orthonormal set of bi-level functions, such as a set of functions derived from a Walsh matrix or from pseudo-random binary sequences. In a display 10 having N rows grouped r in a group, B=N/r number of row signals are required. The B row functions $S_m$ are periodic in time, and the period is divided into R time intervals, $\Delta t_k$ (where k= 1 to R). Therefore, there is a total of B unique row functions $S_m$, one for each group 48 of row electrodes 28, with each divided into R number of time intervals $\Delta t_k$. For example, if a subset of B rows of a $2^t \times 2^t$ Walsh matrix were used as row functions $S_m$, the number of time intervals R would be at least $2^t$.

By reducing the number of row signals required by approximately a factor of r, the present invention allows the row signals to be selected from a smaller function set, thereby reducing the number of intervals R required during an addressing interval. For example, without the present invention, each section of a dual scan display may include 240 rows and require the use of Walsh functions of order 8 having 256 ($2^8$) time intervals R. When using an embodiment of the present invention that forms groups of two row electrodes, Walsh functions of order 7 can provide the necessary 120 row functions and require only 128 time intervals. The order "x" of the Walsh function required is determined by the relationship:

$$2^{x-1} < B \leqq 2^x.$$

Decreasing the size of the set of row address functions reduces the hardware and power required to generate row addressing signals and to calculate and generate column addressing signals.

A row function vector $S(\Delta t_k)$ is comprised of individual elements having the value of one of the B row functions $S_i$ at a specific time interval $\Delta t_k$. Because there are at least R time intervals $\Delta t_k$, there are at least R row function vectors $S(\Delta t_k)$. Row function vectors $S(\Delta t_k)$ are applied to row electrode groups 48 of display 12 by row drivers 42 so that each element $S_i$ of row function vector $S(\Delta t_k)$ is applied to the corresponding group $\mathbf{48}_m$ of row electrode 28 at time interval $\Delta t_k$. Row function vectors $S(\Delta t_k)$ are also used by column signal generator 52 in generating column signals $CS_1$-$CS_M$ each having a corresponding amplitude $G_{K_1}(\Delta t_k)$ through $G_{K_M}(\Delta t_k)$ .

Storage circuit 92 or 94 provides to image data conditioner 54 display data in the form of an information vector $I_j$ having information elements $I_{ij}$ corresponding to the desired display state of a corresponding pixel in the $i^{th}$ row and the $j^{th}$ column. Image data conditioner 54 modifies information vector $I_j$ in accordance with the present invention to produce a modified image information vector $K_j$ for each of the M columns of pixels of display 12. The value of each element $K_{mj}$ of the modified information vector $K_j$ is referred to as a group image information value and can correspond to the pixel information value of any of the pixels in group $\mathbf{48}_m$ in the $j^{th}$ column or to a quantity, such as an arithmetic average, derived from the pixel information values of multiple pixels in the $m^{th}$ row group in the $j^{th}$ column. The modified information vector $K_j$ is supplied to column signal generator 52. If the incoming video data is formatted as field data and each group 48 includes 2 row electrodes 28 (r=2), the group information value will typically be the pixel information value for the row electrode 28 that is included in the group 48 and is addressed during the field.

Column signal generator 52 combines each modified information vector $K_j$ with the row function vectors $S(\Delta t_k)$ to generate a column signal $CS_j$ for the $j^{th}$ column during the $k^{th}$ addressing interval. Column signals $CS_1$-$CS_M$, each having amplitude $G_{K_j}(\Delta t_k)$, where $$G_{K_j}(\Delta t_k)=\frac{1}{\sqrt{B}}\sum_{m=1}^{B} K_{mj}\cdot S_m(\Delta t_k),$$

are generated for each of the M column electrode 30 of display 12 for each time interval $\Delta t_k$. When the amplitudes $G_{K_j}(\Delta t_k)$ for all column signals $CS_1$-$CS_M$ are calculated for time interval $\Delta t_k$, all column signals $CS_1$-$CS_M$ are presented, in parallel, via bus 84 to column drivers 85 and then to column electrodes $\mathbf{30}_1$-$\mathbf{30}_M$ during time interval $\Delta t_k$. At the same time, the $K^{th}$ row function vector $S(\Delta t_k)$ is applied to groups $\mathbf{48}_1$ to $\mathbf{48}_B$ of row electrodes 28 via bus 82 through row drivers 42. In some embodiments of the invention, column signals $CS_1$-$CS_M$, row function vector $S(\Delta t_k)$, or both are modified, such as by modulating the polarity to increase high frequency components or by adjusting the magnitude, to correct for the frequency dependence of the optical response of display 12. Such modification is described further in copending U.S. patent application Ser. No. 08/077,859 for "Addressing Method and System Having Minimal Crosstalk Effects," one of the assignees of which is the assignee of the present invention.

In a preferred embodiment, display 12 is capable of displaying multiple gray levels represented by 5 bits of data for each pixel. The three most significant bits of gray level are achieved using the virtual pixel method described in copending U.S. patent application Ser. No. 07/077,859 for "Gray Level Addressing for LCDs," which is assigned to the assignee of the present invention. In the virtual pixel method, each column j contains one or more virtual pixels having associated virtual information elements $V_{kj}$ that is combined with a virtual row signal $SV_k(t)$ to contribute to column signal $CS_j$. Virtual row signal $SV_k(t)$ is one of the set of preferably bi-level orthonormal functions from which row functions $S_m$ are chosen. Each virtual pixel information element has a value of $$V_{Kj}=\pm\sqrt{B-\sum_{m=1}^{B} K_m^2}$$

For an addressing method using n number of virtual pixels, the column signal is then calculated by $$G_{K_j}(\Delta t_k)=\frac{1}{\sqrt{B}}\sum_{m=1}^{B} K_{mj}\cdot S_m+\frac{1}{\sqrt{B}}\sum_{k=B+1}^{B+n} V_{kj}\cdot SV_k$$

In a preferred embodiment, the two least significant bits of the five bit gray level are achieved by using a frame modulation method, which uses temporal dithering over four frames to achieve the remaining two bits of gray scale. Frame modulation gray scale is further described in copending U.S. patent application Ser. No. 07/678,736 for "LCD Addressing System," which is assigned to the assignee of the present invention.

After column signals $CS_1$-$CS_M$ have been applied to column electrodes 30 and row function vector $S(\Delta t_k)$ has been applied to row electrodes 28, the k+1 row function vector $S(\Delta t_{k+1})$ is generated and new column signals $CS_1$-$CS_M$ column signals are generated for the k+1 addressing interval. An addressing cycle is complete when the complete set of row and column signals have been applied to produce across all pixels 36 rms voltages corresponding to the modified information vector $K_{mj}$. Upon completion of the $p^{th}$ addressing cycle, controller 62 instructs the one of the storage circuits 92 or 94 that stored the pixel information values for the completed addressing cycle to begin to accumulate pixel information values for the $p+2^{th}$ addressing cycle, and the next addressing cycle is begun by generating row function vectors $S(\Delta t)$ and column signals $CS_1$-$CS_M$ using data stored in the other one of storage circuits 92 or 94.

In successive addressing cycles periods, the groupings of r rows are changed in such a manner that the new groupings of r rows are cyclically shifted from the previous groupings of r rows by increments of one row. The cyclical shift can proceed in either direction.

Reducing the multiplex rate in this way results in increased display brightness and contrast ratio as well as faster switching and improved display uniformity. The decreased vertical resolution is not expected to degrade the image when a group size r of 2 or 3 is chosen and may actually improve the image.

It will be understood that the details of the image information storage may vary depending upon the application of display 10 without departing from the principles of the invention. For example, FIG. 5 shows an embodiment of a display 108 that reduces data storage requirements by storing group image information data rather than individual pixel data and is, therefore, particularly well suited for implementations in which groups 48 comprises a larger number of row electrodes 28, e.g., r>3.

Figure 5:
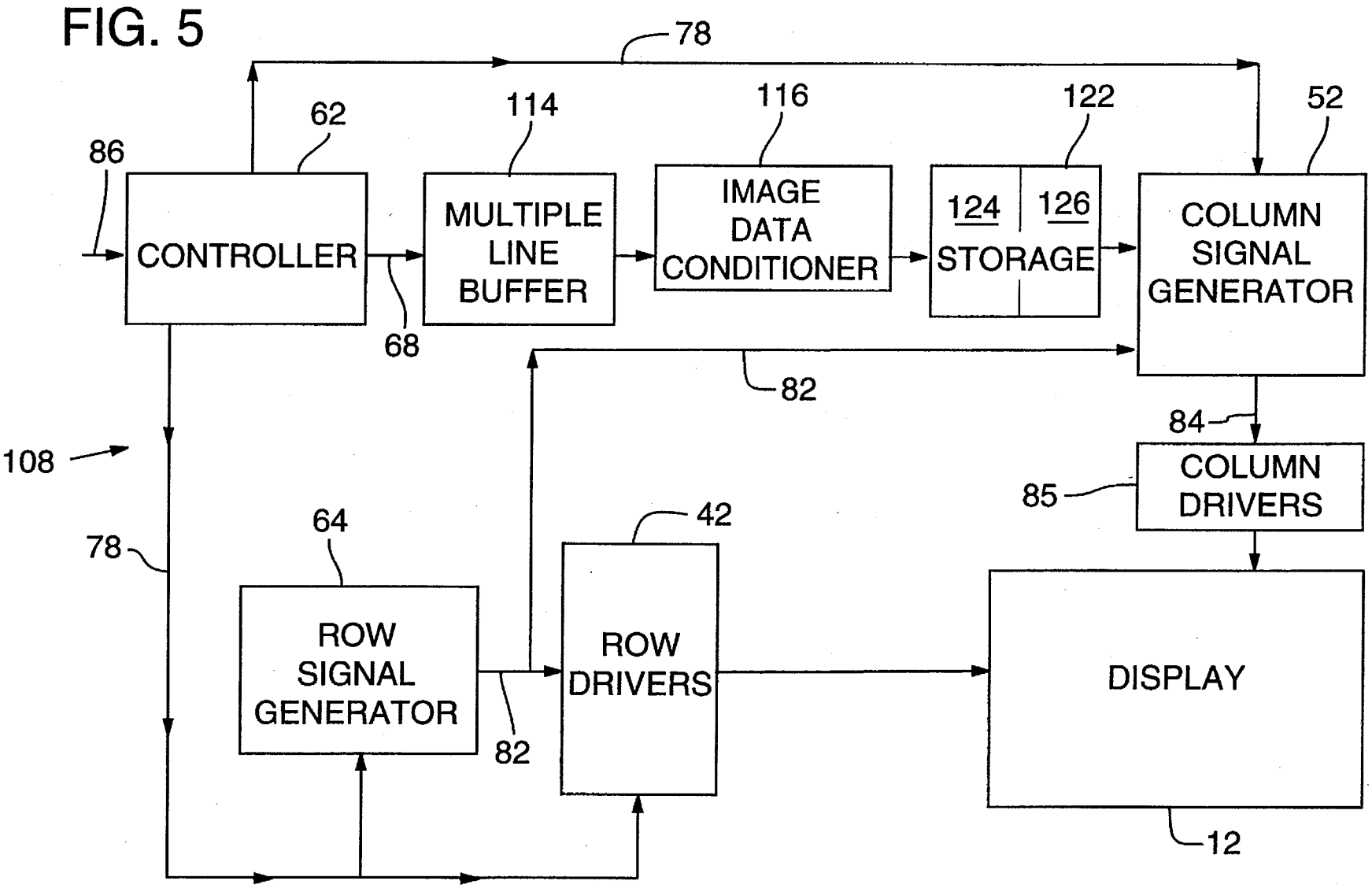
FIG. 5 is a block diagram of a another typical display system of the invention, the display system using an Active Addressing™-type addressing technique and having a reduced memory requirement.

Referring to FIG. 5, controller 62 formats incoming video display data and transmits the formatted data via data bus 68 to a multiple line buffer 114. Multiple line buffer 114 accumulates display data corresponding to the pixels in the r rows and forwards the data to image data conditioner 116. Image data conditioner 116 determines a single group image information value $K_{mj}$ for each column corresponding to the group 48 of row electrodes 28. The group image information values are transmitted to storage means 122 that comprises storage circuits 124 and 126. Storage means 122 and storage circuits 124 and 126 function in a manner similar to that of storage means 60 described above to provide modified image information vectors $K_j$ to column signal generator 52.

Figure 6:
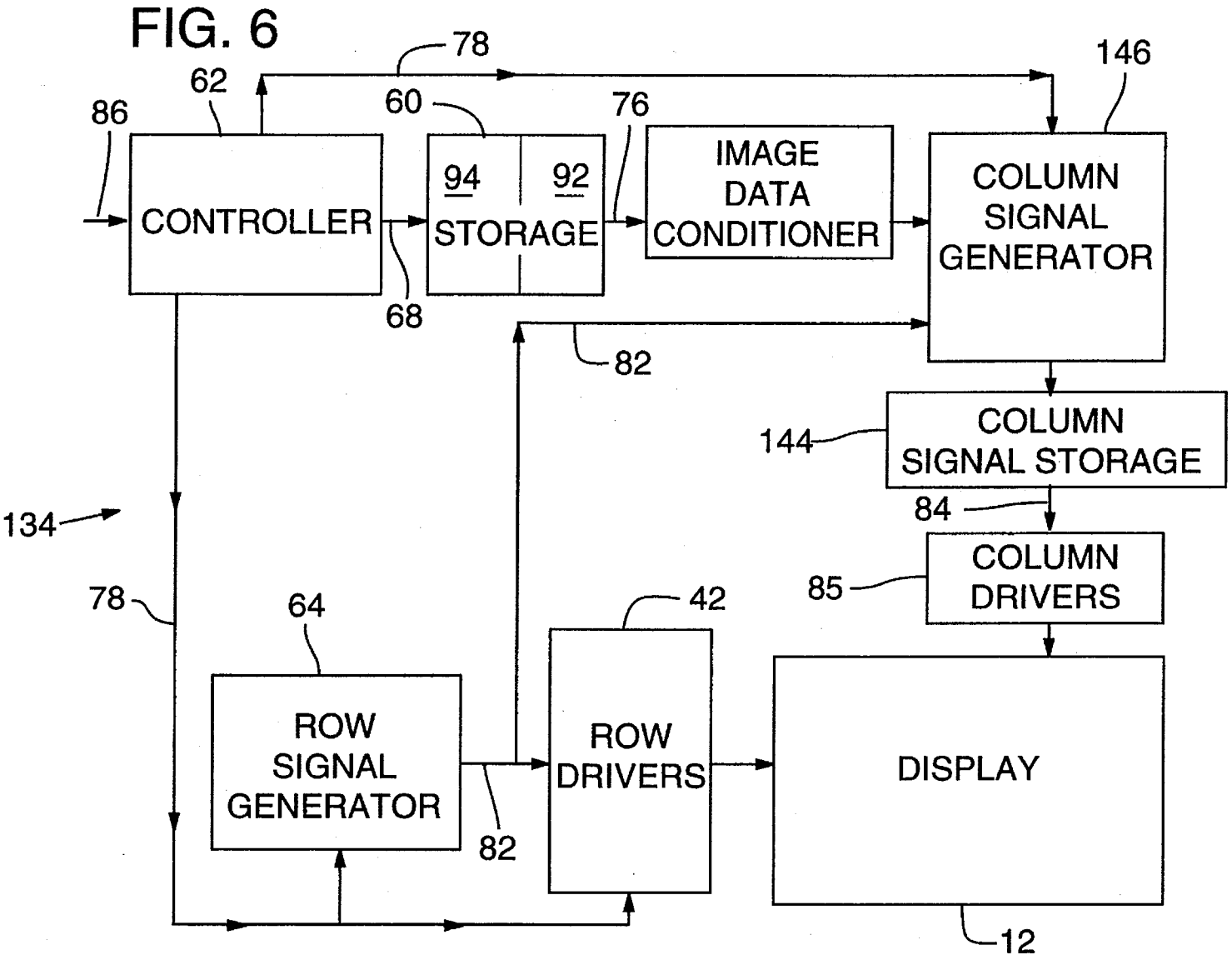
FIG. 6 is a block diagram of another embodiment of a typical display system of the invention, the display system using an Active Addressing™-type addressing technique and incorporating a column signal storage means.

Display 134 shown in FIG. 6 is another embodiment of the present invention using a different method of image data storage. Display 134 uses a column signal storage 144 that receives and stores a complete set of column signals $CS_1$-$CS_M$ for an addressing cycle. A column signal generator 146 generates for the addressing cycle a column signal waveform for each column electrode 30 and sends the waveforms for storage to column signal storage 144 one column after another. Column signal storage 144 then provides the proper column signals during each addressing interval to each of the column drivers 85 for application onto column electrodes 30. Although column signal storage 144 is shown as a single unit, it could be implemented as two memory circuits similar to storage circuits 92 and 94 described above.

The present invention can also be applied to Active Addressing™-type displays that select less than all the row electrodes simultaneously, such as the technique described in U.S. Pat. No. 5,262,881 to Kuwata et al. for "Driving Method of Driving a Liquid Crystal Display Element." Displays that select less than all the row electrodes simultaneously, typically use tri-level row functions to provide two select and one non-select voltages. For example, such a display incorporating the present invention could use groups comprising two row electrodes each and can be addressed by selecting fourteen row electrodes at a time using seven row address functions. It will be understood that the fourteen rows addressed are not necessarily contiguous and that the selection voltages for the fourteen rows may be distributed over the addressing cycle.

It will also be understood that the image data storage described above in the various embodiments may be altered to conform to different addressing schemes. For example, in the embodiment of FIG. 6, storage means 60 may store a reduced data set that corresponds to the row electrodes 28 being selected together when used with an addressing technique such as the one described in U.S. Pat. No. 5,262,881 to Kuwata et al.

It will be obvious that many changes may be made to the details of the above-described embodiments without departing from the underlying principles of the invention. The scope of the present invention should, therefore, be determined only by the following claims.

We claim:

1. A system for addressing a passive matrix display including overlapping first and second electrodes positioned on opposite sides of an rms-responding material to define an array of pixels that have corresponding pixel input data and that display information patterns characterized by optical states that depend on values of rms voltages established across the pixels, the display characterized by an effective multiplex ratio and a selection ratio, the system comprising:

means for applying first signals to corresponding ones of the first electrodes during an addressing cycle, a same first signal being applied to a group of multiple ones of the first electrodes, the grouping of the multiple first electrodes being different for at least one subsequent addressing cycle, the grouping of the multiple first electrode rows reducing the effective multiplex ratio and increasing the selection ratio of the display;

an image data conditioner for determining group image information values corresponding to groups of pixels, each group of pixels defined by a second electrode and a group of the first electrodes and each image information value being determined from the pixel input data of at least one pixel in the group of pixels; and means for generating and applying second signals of changing magnitudes to the second electrodes, each of the second signals having at a particular time during the addressing cycle an amplitude determined by the particular group image information values of the selected groups of first electrodes.

2. The system of claim 1 in which some of the first signals select groups of first electrodes multiple times in the frame period.

3. The system of claim 1 in which corresponding ones of the first signals select groups of first electrodes multiple times, the multiple selections being distributed throughout the addressing cycle.

4. The system of claim 1 in which corresponding ones of the first signals select all of the groups of first electrodes simultaneously.

5. The system of claim 1 in which corresponding ones of the first signals select fewer than all of the groups of first electrodes simultaneously.

6. The system of claim 1 in which multiple ones of the first signals are applied to multiple first electrode groups, each first electrode group including multiple ones of the first electrodes.

7. The system of claim 6 in which the multiple ones of the first electrodes are cyclically shifted in successive addressing cycles.

8. The system of claim 6 in which the first signals select fewer than all of the first electrode groups simultaneously.

9. A method for addressing a passive matrix display including overlapping first and second electrodes positioned on opposite sides of an rms-responding material to define an array of pixels that have corresponding pixel input data and that display information patterns characterized by optical states that depend on rms values of voltages established across the pixels by the application, during each of a repetitive sequence of addressing cycles, of a set of image-independent first signals to the first electrodes and image-dependent signals to the second electrodes, the method comprising:

applying to subsets of the first electrodes during a first addressing cycle in the repetitive sequence the first signals in the set of first signals, each subset of the first electrodes receiving a same first signal, and each subset of the first electrodes together with each second electrode defining a pixel group, each pixel of the group having the same rms voltage applied during the addressing cycle and each group having a group information value corresponding to pixel input data of at least one of the pixels in the group;

generating and applying second signals to the second electrodes during the first addressing cycle, each second signal having a magnitude determined at a particular time during the first addressing cycle from group information values of the particular pixel groups defined by the corresponding second electrode and selected subsets of the first electrodes;

applying during a subsequent addressing cycle of the repetitive sequence the same first signals in the set of first signals to different subsets of the first electrodes from the subsets to which the first signals were applied during the first addressing cycle; and generating and applying second signals to the second electrodes during the subsequent addressing cycle, each second signal having a magnitude determined at a particular time during the addressing cycle from group information values of the particular pixel groups defined by the corresponding second electrode and selected subsets of the first electrodes defined in the subsequent addressing cycle.

10. The method of claim 9 in which no more than a single group of first electrodes is selected at any particular time during the addressing cycle.

11. The method of claim 9 in which the addressing cycle is dividing into multiple time intervals and in which multiple groups of first electrodes are selected during some of the time intervals.

12. The method of claim 11 in which the magnitude of each second signal is determined during at least some of the multiple time intervals by summing products of the magnitudes of the first signals causing selections of subsets of the first electrodes and the group information elements of the corresponding pixels groups.

13. The method of claim 11 in which fewer than all of the subsets of first electrodes are simultaneously selected during at least one time intervals.

14. The method of claim 9 in which each of the subsets of the first electrodes is selected multiple times during the addressing cycle.

15. The method of claim 9 in which membership in the subsets of the first electrodes is determined by cyclically shifting the first electrodes into different subsets in successive addressing cycles.

16. The method of claim 9 in which the multiple ones of the first electrodes are cyclicly shifted by increments of one first electrode in successive addressing cycles.

17. An addressing method for increasing the selection ratio and improving the contrast ratio in a passive matrix display including overlapping first and second electrodes positioned on opposite sides of an rms-responding material to define an array of pixels that have corresponding pixel input data and that display information patterns characterized by optical states that depend on values of rms voltages established across the pixels, the method comprising:

associating ones of the first electrodes together to form a first set of multiple first electrode groups for an addressing cycle, some of the first electrode groups including more than one of the first electrodes, each first electrode group together with each second electrode defining a pixel group having a group information value determined by pixel input data corresponding to at least one pixel in the group of pixels;

applying first signals to the first set of first electrode groups during an addressing cycle, each group simultaneously receiving the same first signal to decrease the effective multiplex ratio of the display;

generating and applying second signals to the second electrodes, each of the second signals having at a particular time during the addressing cycle an amplitude determined from group information values of the particular pixel groups defined by the corresponding second electrode and the first electrode groups selected at the particular time;

associating different ones of the first electrodes together during a subsequent addressing cycle to form a second set of multiple first electrode groups for the subsequent addressing cycle, some of the first electrode groups in the second set including more than one of the first electrodes, each first electrode group in the second set together with each second electrode defining a pixel group having a group information value determined by pixel input data corresponding to at least one pixel in the group of pixels;

applying the first signals to the second set of first electrode groups during the subsequent addressing cycle, each group of the second set simultaneously receiving the same first signal; and generating and applying second signals to the second electrodes, each of the second signals having at a particular time during the addressing cycle an amplitude determined from group information values of the particular pixel groups defined by the corresponding second electrode and the first electrode groups selected at the particular time, thereby reducing the selection ratio of the display.

18. The method of claim 17 in which no more that a single group of first electrodes is selected at any particular time during the addressing cycle.

19. The method of claim 17 in which the addressing cycle is dividing into multiple time intervals, multiple groups of first electrodes are selected during some of the time intervals, and the second signals during those time intervals are determined by a sum of the products of the group information elements and the magnitudes of the first signals selecting the corresponding groups of first electrodes.

20. The method of claim 17 in which each group of first electrodes is selected multiple times during the addressing cycle.

21. The method of claim 17 in which the associations of the first electrodes are cyclically shifted in successive addressing cycles.

* * * * *